United States Patent [19]

Watanabe

[11] Patent Number: 4,736,305

[45] Date of Patent: Apr. 5, 1988

[54] METHOD OF DETERMINING A DRAFT SCHEDULE FOR A CONTINUOUS ROLLING MILL

[75] Inventor: Fumio Watanabe, Miki, Japan

[73] Assignee: Mitsubishi Denki Kabushiki Kaisha, Japan

[21] Appl. No.: 70,162

[22] Filed: Jul. 2, 1987

Related U.S. Application Data

[63] Continuation-in-part of Ser. No. 758,360, Jul. 24, 1985, abandoned.

[30] Foreign Application Priority Data

Jul. 26, 1984 [JP] Japan ..... 59-158001

[51] Int. Cl.[4] ..... G06F 15/00; B21B 37/00

[52] U.S. Cl. ..... 364/472; 72/11; 72/14; 72/16; 72/243

[58] Field of Search ..... 364/469, 478, 476, 479, 364/472; 72/7–9, 11, 14, 16, 202, 243; 432/11, 18; 266/80, 90; 148/120

[56] References Cited

U.S. PATENT DOCUMENTS

| | | | |
|---|---|---|---|
| 3,906,764 | 9/1975 | Mueller | 364/476 X |
| 4,054,043 | 10/1977 | Eibe | 72/8 |
| 4,335,435 | 6/1982 | Miura | 364/472 |
| 4,458,515 | 6/1984 | Imai | 364/472 X |
| 4,494,205 | 1/1985 | Dairiki et al. | 364/472 |
| 4,520,642 | 6/1985 | Niino et al. | 364/472 X |
| 4,576,027 | 3/1986 | Yoshida et al. | 364/472 X |

OTHER PUBLICATIONS

New Developments of the Sigma–Ro System for Computer Control in Wide and Narrow Hot Strip Mills, Mignon et al.

Crown Control of Hot–Rolled Steel Strip by Changing of Rolling Schedules at Hot Finishing Mills, Yarita et al.

*Primary Examiner*—Jerry Smith

*Assistant Examiner*—Allen MacDonald

*Attorney, Agent, or Firm*—Leydig, Voit & Mayer

[57] ABSTRACT

A method of determining a draft schedule for a continuous rolling mill of n stands which gives consideration to both sheet crown and flatness is disclosed. Using (n−1) simultaneous equations for sheet crown, flatness, and power distribution, the exit side thickness and flatness at each of stands 1 through (n−1) are solved for. The process of solving for thickness and flatness is repeated until the flatnesses at a desired number of stands fall within permissible bounds. The draft schedule obtained by this method allows target values of crown and flatness to be met for the entire rolling cycle.

4 Claims, 3 Drawing Sheets

METHOD OF DETERMINING A DRAFT SCHEDULE FOR A CONTINUOUS ROLLING MILL

This application is a continuation-in-part of application Ser. No. 758,360, filed July 24, 1985 and now abandoned.

BACKGROUND OF THE INVENTION

The present invention relates to a method of determining a draft schedule for a continuous rolling mill, and in particular to a method which permits target values for the crown and flatness of finished sheets to be met.

Japanese Patent Laid Open No. 55-81008 discloses a method of determining a draft schedule for a continous rolling mill in which consideration is given to sheet crown and flatness. In that method, in accordance with the sheet dimensions, the minimum entry side sheet thickness such that the entry side crown will not influence the exit side crown is determined. For the first rolling stand having an entry side thickness less than this minimum entry side thickness and for each stand to the rear of that stand, a crown prediction formula and a rolling load prediction formula are established based on finished sheet target thickness and finished sheet target crown. Using these formulas, the entry side thickness is computed for each stand in succession, using a constant crown ratio for each stand.

However, as can be seen by reference to Equations (2), (4), and (5) explained hereinbelow, if as in that method the crown ratio for the rear stands is held constant (if $K_i=K_{i-1}$, or in other words flatness $X_i=0$), since in the early stages of a rolling cycle, the thermal crown and therefore the roll crown $C_{Ri}$ are small, in order to make the finished sheet crown small it is necessary to make the rolling load $F_i$ small for the rear stands and large for the front stands. However, this can result in a draft schedule in which the rolling load for the front stands exceeds allowable bounds and becomes too large for rolling to be possible. Conversely, in the final stages of a rolling cycle, the thermal crown and therefore the roll crown become large. Therefore, it becomes necessary to make the rolling load small for the front stands and large for the rear stands, and a draft schedule can result in which the rolling load for the rear stands exceeds allowable bounds, making rolling impossible.

SUMMARY OF THE INVENTION

It is the object of the present invention to overcome the above-described drawbacks of presently existing methods and to provide a method of determining a draft schedule for a continuous rolling mill which will enable target values for the crown and flatness of finished sheets to be met, and which can hold the exit side flatness for each stand to within allowable bounds which will not hinder rolling operations so that rolling is possible throughout the entire rolling cycle.

A method of determining a draft schedule for a continuous rolling mill of n stands and operating the rolling mill in accordance with the draft schedule comprises the steps of:

(a) determining the target exit side flatness, the target sheet crown, and the target sheet thickness for Stand n, the target power distribution ratios for Stand 1 through Stand (n−2), and the value of m, which is an integer related to the number of stands over which power is distributed, m having an initial value of n;

(b) calculating the exit side sheet thickness for Stand 1 through Stand (n−1) using a total of n−1) equations comprising (m−3) power distribution equations for guaranteeing the target power distribution ratios for Stand 1 through Stand (m−2), (n−m+1) flatness equations for guaranteeing the target exit side flatness for Stand m through Stand n, and one sheet crown equation for guaranteeing the target exit side sheet crown of Stand n;

(c) finding the exit side flatness of Stand 1 through Stand (n−1) based on the exit side sheet thicknesses determined in Step (b) for Stand 1 through Stand (n−1);

(d) checking whether the exit side flatnesses determined in Step (c) lie within allowable bounds, and performing Step (e) if they do not and performing Step (f) it they do lie within allowable bounds;

(e) setting m equal to k where k is the stand number of the farthest downstream stand whose exit side flatness is outside of allowable bounds, assigning target exit side flatnesses to Stand k through Stand (n−1), and returning to Step (b);

(f) using the exit side sheet thicknesses determined in Step (b) for Stand 1 to Stand (n−1) as the draft schedule;

(g) setting the power distribution $P_i$ over Stand 1 to Stand n in accordance with the power distribution values guaranteeing the target power distribution ratios used in step (a); and (h) operating the rolling mill to produce rolled sheet using Stand 1 to Stand n over which power is distributed.

FIGS. *4a–4d* are graphs of examples of rolling reduction, sheet crown, power distribution ratio, and flatness, respectively, for each stand of a 6-stand rolling mill, determined according to the method of the present invention.

DESCRIPTION OF THE PREFERRED EMBODIMENT

First, in order to aid the understanding of the present invention, an explanation will be made of sheet crown, sheet crown ratio, and flatness.

Figure 1:
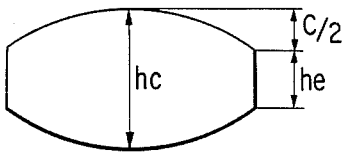
FIG. 1 is a schematic transverse cross-sectional view of a sheet, illustrating sheet crown C.

Sheet crown (C) and sheet crown ratio (K) are defined as follows:

$$C=h_c-h_e \quad (1)$$

$$K=C/h_c=(h_c-h_e)/h_c \quad (2)$$

where $h_c$ is the sheet thickness at the widthwise center of a sheet and $h_e$ is the thickness at the edges of the sheet, as illustrated in FIG. 1, which is a schematic transverse cross-sectional view of a sheet.

Figure 2:
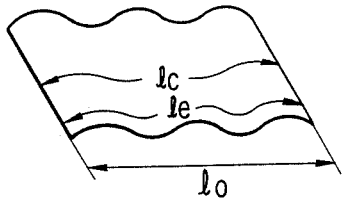
FIG. 2 is a schematic view of a sheet of length $l_o$ having center buckles with an arc length of $l_c$ and edge waves with an arc length of $l_e$.

Flatness X, which is the difference in the percent elongation of two portions of a sheet, is expressed by the following equation:

$$X=(l_e=l_c)/l_o \quad (3)$$

wherein $l_o$ is a standard sheet length, $l_c$ is the arc length of center buckles in a section of length $l_o$, and $l_e$ is the arc length of edge waves in the same section of length $l_o$, as illustrated in FIG. 2, which is a perspective view of a section sheet having a length of $l_o$.

The sheet crown $C_i$ on the exit side of the ith stand in a continuous rolling mill is given by the following equation:

$$C_i=a_{1i}F_i-a_{2i}C_{Ri}+a_{3i}C_{i-1} \quad (4)$$

wherein i is the stand number, $F_i$ is the rolling load for the ith stand, $C_{Ri}$ is the roll crown for the ith stand (the sum of thermal crown, wear crown, and initial roll crown), and $a_{1i}$, $a_{2i}$, and $a_{3i}$ are influence coefficients for the ith stand which depend on the rolling conditions.

The exit side flatness at the ith stand, $X_i$, is given by the following formula:

$$X_i=b_i(K_i-K_{i-1}) \quad (5)$$

wherein $b_i$ is an influence coefficient ($0 \leqq b_i \leqq 1$) which determines the extent to which changes in the sheet crown ratio effect exit side flatness. The magnitude of $b_i$ is inversely related to sheet thickness.

Next, the principles behind the present invention will be explained. In Equations (4) and (5), $F_i$ is a function of $h_i$ and $h_{i-1}$, and furthermore $C_i$, $K_i$, and $K_{i-1}$ are functions of $h_o$ through $h_i$ and the initial sheet crown $C_o$. Therefore, the exit side flatness $X_i$ for the ith stand can be calculated given the exit side thickness $h_i$, the initial thickness $h_o$, and the initial crown $C_o$ in the following manner. In a continuous rolling mill with n stands, there are n unknown thicknesses ($h_1$ to $h_{n-1}$) which must be determined in order to form a draft schedule, $h_o$ being already known and $h_n$ being assigned a target value. To determine these thicknesses, n−1 equations are necessary. The value of each of these thicknesses can be determined by solving equations which set the finished sheet thickness $h_n$, the finished sheet crown $C_n$, and the finished sheet flatness $X_n$ equal to the target values $h^*_n$, $C^*_n$, and $X^*_n$, respectively. The equation for setting the finished sheet crown equal to the target value is $$C_n=a_{1n}F_n-a_{2n}C_{Rn}+a_{3n}C_{n-1}=C^*_n \quad (6)$$

and the equation for setting the finished flatness equal to the target value is $$X_n=b_n(K_n-K_{n-1})=X^*_n \quad (7)$$

These two equations are necessary. As for the remaining (n−3) equations (n−1−2), since it is sufficient for the flatness for each stand to be within allowable bounds, there are degrees of freedom. The allowable bounds for flatness are given by the following equation. (It is not necessary to consider the flatness for the final stand since its exit side flatness is set equal to the target value $X^*_n$).

$$X_i^{min} \leqq X_i \leqq X_i^{max} \text{ (for } i=1 \text{ to } n-1) \quad (8)$$

If for simplicity $X_i^{min}$ is set equal to $-X_i^{max}$, then $$|X_i| \leqq X_i^{max} \text{ for } i=1 \text{ to } n-1 \quad (9)$$

In order to form the remaining n−3 equations, first let us consider the load (power or rolling load) distribution for the front stands. In the following explanation, "load" is used to refer to power, but it may be considered to mean rolling load with no difference in the results. The equation relating the power $P_i$ for each of the first through (m−2) stands to the target power distribution ratio $Y_i$ ($i=1$ to $m-2$) is $$P_i/Y_i-P_{i+1}/Y_{i+1}=0 \text{ for } i=1 \text{ to } m-3 \quad (10)$$

wherein m=n. The coefficient m is an integer constant related to the number of stands over which power is distributed. Power distribution is carried out for stands 1 to (m−2).

From the n−1 equations consisting of Equations (6), (7), and (10), the values of sheet thickness $h_1$ to $h_{n-1}$ for stands 1 to (n−1) can be calculated by a suitable numerical convergence method, such as the Newton-Raphson method. Since flatness $X_i$ is a function of sheet thickness $h_i$, it can be calculated at the same time.

Next, beginning with stand number (m−1) and proceeding upstream towards stand 1, it is checked whether the flatness $X_i$ is within allowable bounds. If the exit side flatness at each stand is within allowable bounds, the draft schedule is complete.

However, if the flatness for any stand is found to be outside of allowable bounds, the target flatness $X^*_k$ for stand number k, which is the rearmost of the stands whose flatnesses are outside of allowable bounds, is redetermined using the following equation:

$$X^*_k=X_k^{max} \times sgn(X_k) \quad (11)$$

wherein the function $sgn(X_k)$ is equal to plus or minus one, depending on whether $X_k$ is positive or negative, respectively.

When the allowable bounds for flatness are expressed by Equation (8), if $X_k<X_k^{min}$, then $X^*_k$ is set equal to $X_x^{min}$, and if $X_k<X_k^{max}$ then $X^*_k$ is set equal to $X_k^{max}$.

Since the exit side flatness at any stand j ($j=k+1$ to n−1) downstream of stand k is within allowable bounds, the target flatness $X^*_j$ is set equal to the previously calculated value $X_j$.

$$X^*_j=X_j \text{ for } j=k=k+1 \text{ to } n-1 \quad (12)$$

Based on equations (11) and (12), we get the following equation for flatness:

$$X_i=X^*_i \text{ for } i=k \text{ to } n-1 \quad (13)$$

If one considers Equation (10) with m=k, then there are k−3 equations for satisfying the conditions of power distribution. In addition, there are (n−k+1) equations related to flatness based on Equations (7) and (13), and 1 equation related to sheet crown of the form of Equation (6), for a total of (n−1) equations. In the same manner as before, these (n−1) equations are solved to recalculate the exit side thickness $h_i$ and flatness $X_i$ for each stand. If the exit side flatness for each stand is then found to be within allowable bounds, the draft schedule is complete.

If as in the above manner calculations are repeated so that the flatness is made to be within allowable bounds, a draft schedule can be obtained in which the finished sheet target values $h^*_n$, $C^*_n$, and $X^*_n$ can be achieved, and the exit side flatness $X_i$ for each stand can be maintained within allowable bounds.

An example of determining a draft schedule for a 6-stand continuous rolling mill will now be explained with reference to FIG. 3, which is a flow chart of the present method.

In the flow chart, Step 101 is a step of determining the target exit side flatness, the target sheet crown, and the target sheet thickness for Stand n and the target power distribution ratios for Stand 1 through Stand (n−2) and the value of m, which is an integer related to the number of stands over which power is distributed, m having an initial value of n. Steps 102, 106, and 110 are steps of calculating the exit side sheet thickness and exit side flatness for Stand 1 through Stand (n−1). Steps 103, 104, and 107 are steps of checking the previously determined flatnesses to see if they are within allowable bounds. Steps 105, 108, and 109 are steps of resetting the value of m and the values of the target flatnesses for Stand m through Stand 5 and of supplying these new values for m and flatness to either Step 106 or Step 110, and Step 111 is a step of using the values for exit side thickness computed in Step 102, 106, or 110 as the draft schedule.

Figure 3:
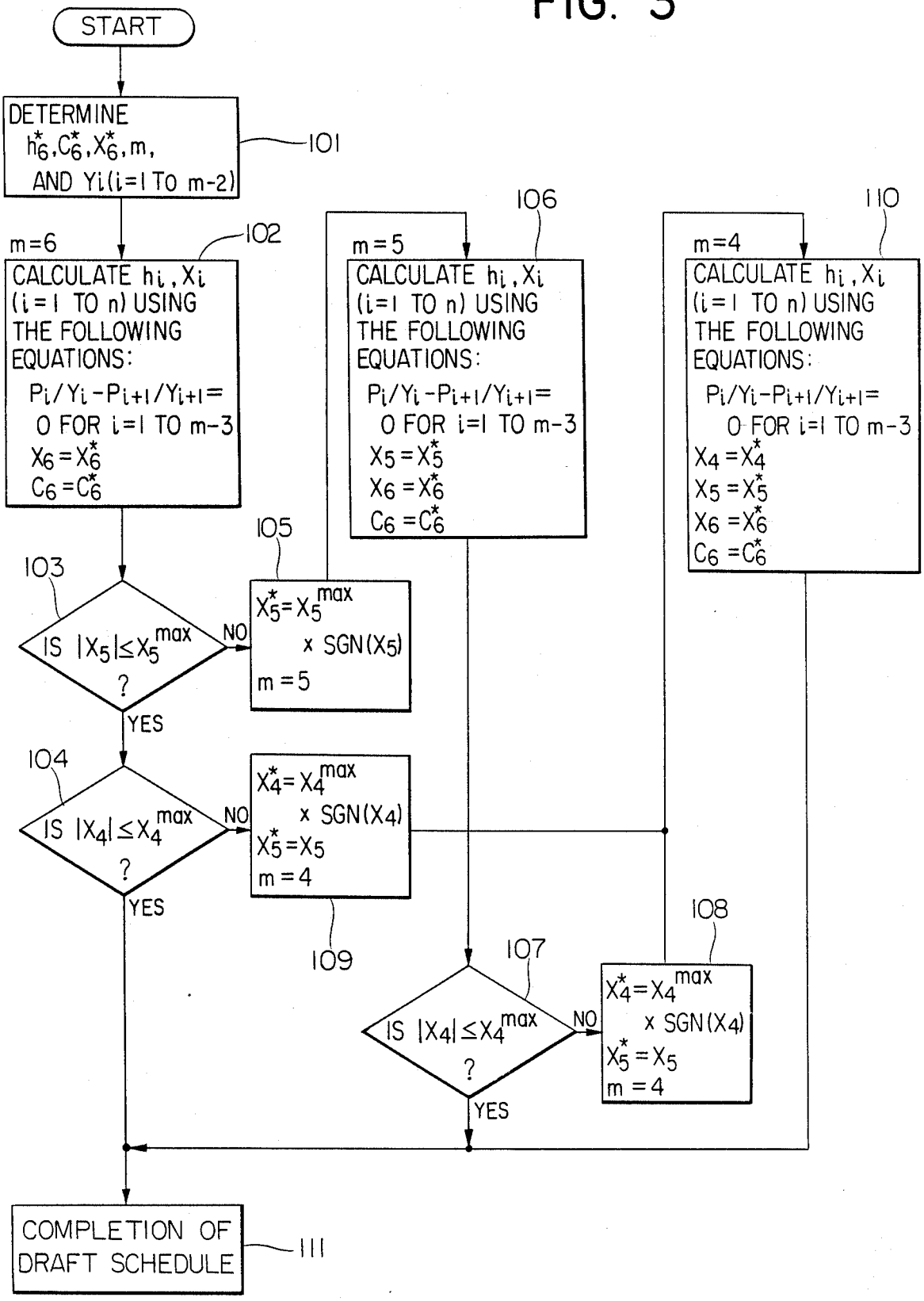
FIG. 3 is a flow chart of the method according to the present invention for a 6-stand mill.

In STEP 101 of FIG. 3, the target value for the finished sheet thickness $h^*_6$, the target value for the finished sheet crown $C^*_6$, the target value for the finished sheet flatness $X^*_6$, the initial value of m (an integer related to the number of stands, which in this case is initially 6), and the target values of the power distribution ratios $Y_i$ ($i=1$ to $m-2$) are selected.

Next, in STEP 102, the exit side thickness $h_i$ and the exit side flatness $X_i$ for each stand are calculated using 3 equations for power distribution, 1 equation for flatness, and 1 equation for sheet crown.

Next, in STEP 103, it is checked whether the exit side flatness $X_5$ for the 5th stand is within allowable bounds. If so, STEP 104 is carried out. If in STEP 104 the exit side flatness $X_4$ for the 4th stand is found to be within allowable bounds, then STEP 111 is carried out and the sheet thicknesses calculated in STEP 102 are used for the draft schedule.

However, in STEP 103, if $X_5$ is found to be outside of allowable bounds, STEP 105 is carried out in which $X^*_5$ is set equal to $X_5^{max}$ x sgn($X_5$) and m is set equal to 5.

Next, STEP 106 is carried out, and the exit side thickness $h_i$ and the exit side flatness $X_i$ for each stand are calculated using 2 equations for power distribution, 2 equations for flatness, and 1 equation for crown.

Next, in STEP 107, it is checked whether the value of $X_4$ calculated in STEP 106 is within allowable bounds. If so, STEP 111 is carried out and the draft schedule calculated in STEP 106 is used as the final draft schedule.

If in STEP 107 the value of $X_4$ calculated in STEP 106 is found to be outside of allowable bounds, STEP 108 is carried out and the target value of the exit side flatness $X^*_4$ for the 4th stand is set equal to $X_4^{max}$x sgn($X_4$), m is set equal to 4, and the target value $X^*_5$ for the exit side flatness of the 5th stand is set equal to $X_5$. (In STEP 106, $X_5$ was set equal to $X^*_5$, so if in STEP 108 $X^*_5$ is set equal to $X_5^{max}$sgn($X_5$), the value of $X_5$ is the same.

Next, in STEP 110, the exit side thickness $h_i$ and the exit side flatness $X_i$ for each stand are calculated using 1 equation for power distribution, 3 equations for flatness, and 1 equation for sheet crown. Upon performing STEP 110, a final draft schedule is obtained and so STEP 111 is carried out.

If in STEP 104 the value of $X_4$ is found to be outside allowable bounds, then STEP 109 is performed in which $X^*_4$ is set equal to $X_4^{max}$ x sgn($X_4$), $X^*_5$ is set equal to $X_5$, and m is set equal to 4.

After STEP 109, STEP 110 is performed and the exit side thickness $h_i$ and flatness $X_i$ for each stand are calculated as described above, thereby obtaining a final draft schedule.

In this example, the reason why calculations were terminated following a check of the exit side flatness $X_4$ for the 4th stand is that normally the values of $b_i$ ($b_1$, $b_2$, and $b_3$) in Equation 5 are small for the front 3 stands. Accordingly, the exit side flatnesses $X_1$, $X_2$, and $X_3$ for the front 3 stands are normally within allowable bounds.

However, if $X_3$ should fall outside of allowable bounds, then new values of $X_i$ and $h_i$ can be calculated in the same manner as above, setting $X_3$ equal to $X^*_3$. The same applies for the other upstream stands.

Figure 4:
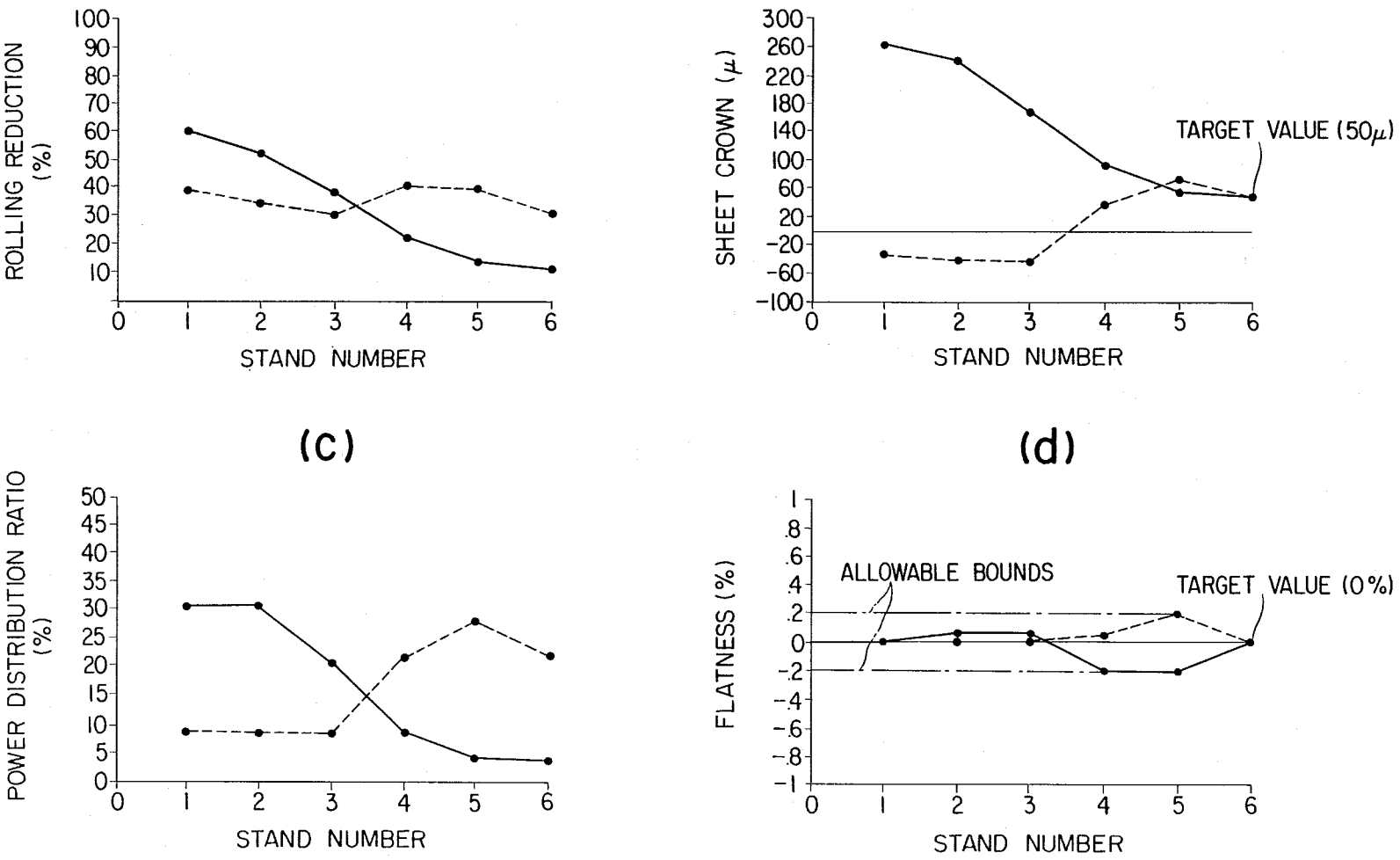

FIG. 4 shows a draft schedule for a 6-stand rolling mill determined according to the method of the present invention. The initial sheet thickness was 30 mm, the initial sheet crown was 0μ, the target thickness for the finished sheet was 2 mm, the target crown for the finished sheet was 50μ, the target flatness for the finished sheet was 0%, and the front stand power distribution ratio was constant.

The solid line in each graph is a representative example of values for the initial stages of a rolling cycle and shows the draft schedule when the roll crown for all of the stands was 0μ. The dashed line in each graph is a representative example of values for the final stages of a rolling cycle and shows the draft schedule when the roll crowns for the first through sixth stands were 210μ, 196μ, 182μ, 168μ, 154μ, and 140μ, respectively. For both cases, the target values were achieved, and the exit side flatness for each stand was within the allowable bounds of ±0.2%. The values for the intermediate stages of a rolling cycle would lie somewhere between the values shown by the dashed lines and the values shown by the solid lines.

As can be seen from the preceding example, the method of determining a draft schedule according to the present invention provides a draft schedule which allows target values of finished sheet crown and finished sheet flatness to be achieved over the entire rolling cycle.

In this example, the power distribution ratio for the front stands was satisfied. However, an equivalent rolling schedule can be determined by satisfying the rolling load distribution ratio.

In the above example, the exit side flatness was not checked for any stands upstream of the 4th stand, but the present method can of course be expanded so as to involve the checking of the exit side flatness for stands upsteam thereof in the same manner as for the 4th stand.

In STEP 109 of FIG. 3, $X^*_j$ is set equal to $X_j$ in accordance with Equation (12). However, $X^*_j$ may be set equal to any value within allowable bounds and may be chosen by taking into consideration the load balance between the stands upstream and downstream of the jth stand.

What is claimed is:

1. A method of determining a draft schedule for a continuous rolling mill on n stands and operating the rolling mill in accordance with the draft schedule comprising the steps of:

(a) determining tha target exit side flatness, the target sheet crown, and the target sheet thickness for Stand n and the target power distribution ratios for Stand 1 through Stand (n−2) and the value of m, which is an integer related to the number of stands over which power is distributed, m having an initial value of n;

(b) Calculating the exit side sheet thickness for Stand 1 though Stand (n−1) using a total of (n−1) equations comprising (m−3) power distribution equations for guaranteeing the target power distribution ratios for Stand 1 through Stand (m−2), (n−m+1) flatness equations for guaranteeing the target exit side flatness for Stand m through Stand n, and one sheet crown equation for guaranteeing the target exit side sheet crown of Stand n;

(c) finding the exit side flatnesses of Stand 1 through Stand (n−1) based on the exit side sheet thicknesses determined in Step (b) for Stand 1 through Stand (n−1);

(d) checking whether there is an exit side flatness determined in Step (c) which lies outside of allowable bounds, and performing Step (e) if there is and performing Step (f) if there is not a flatness lying outside of allowable bounds;

(e) setting m equal to k where k is the stand number of the farthest downstream stand whose exit side flatness is outside of allowable bounds, assigning target exit side flatnesses to Stand k through Stand (n−1), and returning to Step (b);

(f) using the exit side sheet thicknesses determined in Step (b) for Stand 1 to Stand (n−1) as the draft schedule;

(g) setting the power distribution $P_i$ over Stand 1 to Stand n in accordance with power distribution values guaranteeing the target power distribution ratios used in step (a); and (h) operating the rolling mill to produce rolled sheet using Stand 1 to Stand n over which power is distributed as set in step (g).

2. A method of determining a draft schedule and operating a rolling mill as claimed in claim 1 wherein the power distribution equations are $$P_i(h_{i-1};h_i)/Y_i - P_{i+1}(h_i;h_{i+1})/Y_{i+1} = 0$$

in which $P_i$=rolling load at Stand i $h_{i-1}$=exit side thickness at Stand (i−1)

$h_i$=exit side thickness at Stand i $h_{i+1}$=exit side thickness at Stand (i+1)

$Y_i$=target rolling load distribution ratio at Stand i $Y_{i+1}$=target rolling load distribution ratio at Stand (i+1).

3. A method of determining a draft schedule and operating a rolling mill as claimed in claim 1 wherein said flatness equations are $$|C_i|X_i = f(h_1 \text{ to } |h_{i-i}|h_i)$$

in which $X_i$=exit side flatness at Stand i $f(h_1 \text{ to } |h_i)$=a function of $h_l$ to $|h_{i-l}|h_i$ where $h_l$=exit side thickness at Stand 1

$h_i$=exit side thickness at Stand i.

4. A method of determining a draft schedule and operating a rolling mill as claimed in claim 1 wherein said sheet crown equation is $$C_i = |g(h_i \text{ to } h_{i-1};h_i)|h_l \text{ to } h_i$$

in which $C_i$ is the finished exit side sheet crown at Stand i, and g is a function of $h_l$ to $|h_{i-1}$ and ;$|h_i$ where $h_l$=exit side thickness at Stand 1

$h_i$=exit side thickness at Stand i.

* * * * *